US010393108B2

(12) United States Patent
Chong et al.

(10) Patent No.: US 10,393,108 B2
(45) Date of Patent: Aug. 27, 2019

(54) REDUCING FLUID PRESSURE SPIKES IN A PUMPING SYSTEM

(71) Applicant: SCHLUMBERGER TECHNOLOGY CORPORATION, Sugar Land, TX (US)

(72) Inventors: Jonathan Wun Shiung Chong, Sugar Land, TX (US); Lewis Callaway, Sugar Land, TX (US); Kim Hodgson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 247 days.

(21) Appl. No.: 15/300,938

(22) PCT Filed: Mar. 30, 2015

(86) PCT No.: PCT/US2015/023296

§ 371 (c)(1),
(2) Date: Sep. 30, 2016

(87) PCT Pub. No.: WO2015/153432

PCT Pub. Date: Oct. 8, 2015

(65) Prior Publication Data

US 2017/0016433 A1 Jan. 19, 2017

Related U.S. Application Data

(60) Provisional application No. 61/973,050, filed on Mar. 31, 2014.

(51) Int. Cl.
*F04B 1/00* (2006.01)
*F04B 23/04* (2006.01)
(Continued)

(52) U.S. Cl.
CPC ..... *F04B 51/00* (2013.01); *F04B 1/00* (2013.01); *F04B 23/04* (2013.01); *F04B 23/06* (2013.01);
(Continued)

(58) Field of Classification Search
CPC .. F04B 1/00; F04B 23/04; F04B 51/00; F04B 2201/0201; F04B 2205/03; F04B 2205/04; F04B 23/06; F04B 49/065
(Continued)

(56) References Cited

U.S. PATENT DOCUMENTS 4,705,459 A * 11/1987 Buisine ..... F04B 51/00 137/554
5,246,355 A 9/1993 Matzner et al.
(Continued)

OTHER PUBLICATIONS

International Search Report and Written Opinion issued in International Patent Application No. PCT/US2015/023296 dated Jun. 29, 2015; 10 pages.
(Continued)

*Primary Examiner* — Peter J Bertheaud

(57) ABSTRACT

A pumping system including a plurality of pumps each having a pump fluid outlet, a drive shaft, a prime mover, and fluid displacing members operatively coupled with the drive shaft. A common fluid conduit may be fluidly coupled with each pump fluid outlet. A control system of the pumping system includes position sensors operable to generate information relating to phase and/or speed of each pump, pressure sensors operable to generate information relating to fluid pressure spikes, and a controller in communication with the position and pressure sensors. The controller is operable to cause the prime movers to adjust the phasing of the pumps with respect to each other, based on the information relating to fluid pressure spikes, and synchronize the speed of the pumps.

18 Claims, 9 Drawing Sheets

(51) Int. Cl.

| | |
|---|---|
| ***F04B 23/06*** | (2006.01) |
| ***F04B 51/00*** | (2006.01) |
| ***F04B 49/06*** | (2006.01) |
| ***F04B 49/20*** | (2006.01) |
| *F04B 17/03* | (2006.01) |
| *F04B 11/00* | (2006.01) |
| *E21B 43/26* | (2006.01) |
| *F04B 17/05* | (2006.01) |

(52) U.S. Cl.
CPC ..... *F04B 49/065* (2013.01); *F04B 49/20* (2013.01); *E21B 43/26* (2013.01); *F04B 11/0058* (2013.01); *F04B 17/03* (2013.01); *F04B 17/05* (2013.01); *F04B 2201/0201* (2013.01); *F04B 2205/03* (2013.01); *F04B 2205/04* (2013.01); *F04B 2205/05* (2013.01)

(58) Field of Classification Search
USPC ..... 417/2–8, 216
See application file for complete search history.

(56) References Cited

U.S. PATENT DOCUMENTS

| | | | | |
|---|---|---|---|---|
| 5,259,731 | A | 11/1993 | Dhindsa et al. | |
| 5,522,707 | A | 6/1996 | Potter | |
| 5,755,561 | A | 5/1998 | Couillard et al. | |
| 5,971,714 | A | 10/1999 | Schaffer et al. | |
| 7,542,875 | B2 * | 6/2009 | Rogers ..... | F04B 51/00 417/63 |
| 7,581,449 | B2 | 9/2009 | Miller | |
| 7,811,064 | B2 | 10/2010 | Allen | |
| 2004/0256097 | A1 | 12/2004 | Byrd et al. | |
| 2007/0017672 | A1 | 1/2007 | Kayadarma | |
| 2011/0189028 | A1 | 8/2011 | Shampine et al. | |
| 2012/0255734 | A1 | 10/2012 | Coli et al. | |

OTHER PUBLICATIONS

International Search Report and Written Opinion issued in International Patent Application No. PCT/US2016/014475 dated Jan. 22, 2016; 17 pages.

* cited by examiner

REDUCING FLUID PRESSURE SPIKES IN A PUMPING SYSTEM

CROSS-REFERENCE TO RELATED APPLICATIONS

This application is a 371 National Phase Application of International Patent Application No. PCT/US2015/023296, filed Mar. 30, 2015, which claims the benefit of and priority to U.S. Provisional Application No. 61/973,050, entitled "Method for Minimizing Pressure Pulsations for Multiple Pumps," filed Mar. 31, 2014. The entire disclosures of both applications are hereby incorporated herein by reference.

BACKGROUND OF THE DISCLOSURE

In oilfield operations, reciprocating pumps are utilized at wellsites for large scale, high-pressure operations. Such operations may include drilling, cementing, acidizing, water jet cutting, and hydraulic fracturing of subterranean formations. In some applications, several pumps may be connected in parallel to a single manifold, flow line, or well. Some reciprocating pumps include reciprocating members driven by a crankshaft toward and away from a fluid chamber to alternatingly draw in, pressurize, and expel fluid from the fluid chamber. Hydraulic fracturing of a subterranean formation, for example, may utilize fluid at a pressure exceeding 10,000 PSI.

The success of the pumping operations may be related to many factors, including physical size, weight, failure rates, and safety. Although reciprocating pumps may operate well at high pressures, the pressurized fluid is discharged in an oscillating manner forming fluid pressure spikes at the pump outlet. These oscillating fluid pressure spikes may be amplified in a pumping system comprising two or more reciprocating pumps due to resonance phenomena caused by interaction between two or more fluid flows. The resulting amplified high-pressure spikes may be transmitted through a piping system and/or other portions of the pumping system connected downstream from the reciprocating pumps. Piping, hose, and equipment failures have been linked to the high-pressure spikes. Pressure failures may be reduced by over-designing portions of the pumping systems with large safety factors and by introducing dampening systems. Such solutions, however, increase the size, weight, and cost of the pumping systems.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a pumping system and a control system. The pumping system includes multiple pumps that each include a drive shaft, a prime mover operatively coupled with the drive shaft and operable to rotate the drive shaft, reciprocating members operable to pump a fluid, connecting rods operatively connecting the drive shaft with the reciprocating members, and a pump fluid outlet. The control system includes multiple position sensors each associated with a corresponding one of the pumps. Each of the position sensors is operable to generate information relating to phase and/or speed of the corresponding one of the pumps. The control system also includes multiple pressure sensors each associated with a corresponding one of the pumps. Each of the pressure sensors is operable to generate information relating to fluid pressure spikes at a corresponding pump fluid outlet. The control system also includes a controller in communication with the position sensors and the pressure sensors. The controller is operable to cause each of the pumps to operate such that each fluid pressure spike at each pump fluid outlet is out of phase with respect to another fluid pressure spike at another pump fluid outlet.

The present disclosure also introduces an apparatus that includes a pumping system, a common fluid conduit, and a control system. The a pumping system includes multiple pumps that each include a housing, a pump fluid outlet, a drive shaft disposed within the housing, a prime mover operatively coupled with the drive shaft and operable to rotate the drive shaft, and fluid displacing members each operatively coupled with the drive shaft. The common fluid conduit is fluidly coupled with each pump fluid outlet. The control system includes multiple position sensors each associated with a corresponding one of the pumps. Each of the position sensors is operable to generate information relating to phase and/or speed of the corresponding one of the pumps. The control system also includes multiple pressure sensors each operable to generate information relating to fluid pressure spikes, as well as a controller in communication with the position sensors and the pressure sensors. The controller is operable to cause the prime mover to adjust the phase of one or more of the pumps with respect to the phase of another of the pumps based on the information relating to fluid pressure spikes, and to synchronize the speed of the pumps.

The present disclosure also introduces a method that includes conducting pumping operations with multiple pumps each including a drive shaft, a prime mover operatively coupled with the drive shaft, and reciprocating members. Conducting pumping operations includes powering each prime mover to rotate each drive shaft and thereby cause each of the reciprocating members to reciprocate and thereby pump a fluid, monitoring phase and/or speed of each of the pumps, monitoring fluid pressure within a pumping system comprising the pumps, including information relating to fluid pressure spikes within the pumping system, synchronizing the speed of each of the pumps, and adjusting the phase of one or more of the pumps with respect to the phase of another of the pumps based on the information relating to fluid pressure spikes within the pumping system.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
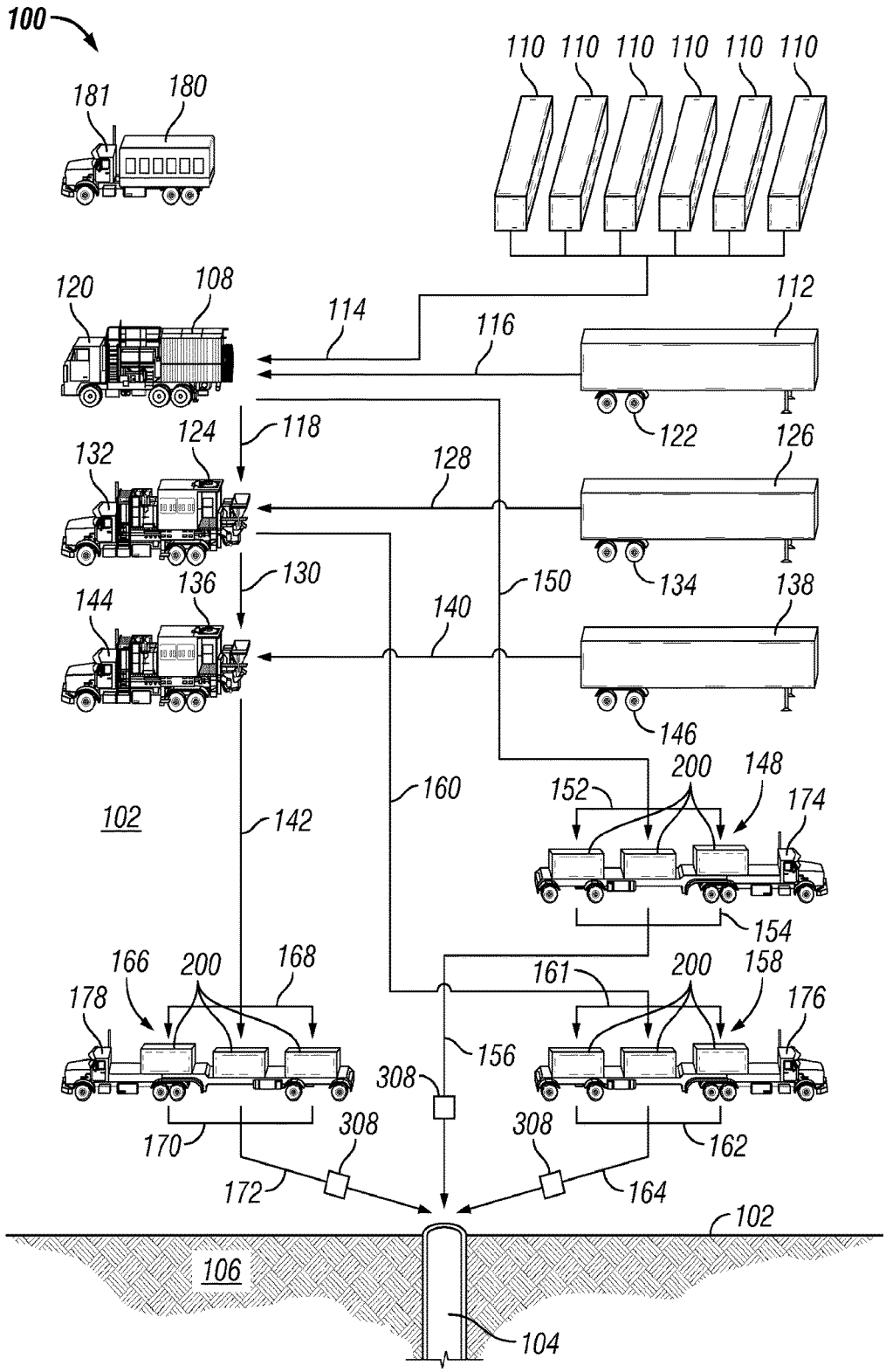
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example pumping system 100 according to one or more aspects of the present disclosure. The figure depicts a wellsite surface 102 adjacent to a wellbore 104 and a partial sectional view of the subterranean formation 106 penetrated by the wellbore 104 below the wellsite surface 102. The pumping system 100 may comprise a first mixer 108 fluidly connected with one or more tanks 110 and a first container 112. The first container 112 may contain a first material and the tanks 110 may contain a liquid. The first material may be or comprise a hydratable material or gelling agent, such as guar, a polymer, a synthetic polymer, a galactomannan, a polysaccharide, a cellulose, and/or a clay, among other examples, and the liquid may be or comprise an aqueous fluid, which may comprise water or an aqueous solution comprising water, among other examples. The first mixer 108 may be operable to receive the first material and the liquid via two or more fluid conduits 114, 116, and mix or otherwise combine the first material and the liquid to form a base fluid. The base fluid may be or comprise that which is known in the art as a gel. The first mixer 108 may then discharge the base fluid via one or more fluid conduits 118.

The first mixer 108 and the first container 112 may each be disposed on corresponding trucks, trailers, and/or other mobile carriers 120, 122, respectively, such as may permit their transportation to the wellsite surface 102. However, the first mixer 108 and/or first container 112 may be skidded or otherwise stationary, and/or may be temporarily or permanently installed at the wellsite surface 102.

The pumping system 100 may further comprise a second mixer 124 fluidly connected with the first mixer 108 and a second container 126. The second container 126 may contain a second material that may be substantially different than the first material. For example, the second material may be or comprise a polymer, fiberglass, phenol formaldehyde, polyester, polylactic acid, cedar bark, shredded cane stalks, mineral fiber, and/or hair, among other examples. The second material may comprise a fibrous material operable to form a matrix within the base fluid to aid in hydraulic fracturing operations. The second material may also include a dry surfactant, a breaker capable of breaking down polymer chains of the base fluid, and/or other oilfield material. The second mixer 124 may be operable to receive the base fluid from the first mixer 108 via one or more fluid conduits 118, and the second material from the second container 126 via one or more fluid conduits 128, and mix or otherwise combine the base fluid and the second material to form a first mixture. The second mixer 124 may then discharge the first mixture via one or more fluid conduits 130.

The second mixer 124 and the second container 126 may each be disposed on corresponding trucks, trailers, and/or other mobile carriers 132, 134, respectively, such as may permit their transportation to the wellsite surface 102. However, the second mixer 124 and/or second container 126 may be skidded or otherwise stationary, and/or may be temporarily or permanently installed at the wellsite surface 102.

The pumping system 100 may further comprise a third mixer 136 fluidly connected with the second mixer 124 and a third container 138. The third container 138 may contain a third material that may be substantially different than the first and/or second materials. For example, the second material may be or comprise a proppant material, such as may comprise sand, sand-like particles, silica, quartz, and/or propping agents, among other examples. The third mixer 136 may be operable to receive the first mixture from the second mixer 124 via one or more fluid conduits 130, and the third material from the third container 138 via one or more fluid conduits 140, and mix or otherwise combine the first mixture and the third material to form a second mixture. The second mixture may be or comprise that which is known in the art as a fracturing fluid. The third mixer 136 may then discharge the second mixture via one or more fluid conduits 142.

The third mixer 136 and the third container 138 may each be disposed on corresponding trucks, trailers, and/or other mobile carriers 144, 146, respectively, such as may permit their transportation to the wellsite surface 102. However, the third mixer 136 and/or third container 138 may be skidded or otherwise stationary, and/or may be temporarily or permanently installed at the wellsite surface 102.

The pumping system 100 may further be operable to communicate and/or inject the base fluid from the first mixer 108, the first mixture from the second mixer 124, and/or the second mixture from the third mixer 136 into the wellbore 104, via a wellhead (not shown), without first being combined or otherwise mixed together prior to being injected into the wellbore 104.

As shown in FIG. 1, the base fluid may also be discharged from the first mixer 108 and communicated to a first pump fleet 148 via one or more fluid conduits 150. The base fluid may be distributed among a plurality of first pumps 200 of the first pump fleet 148 by a local manifold, a piping system, and/or by other fluid distribution means 152 operable to distribute or otherwise direct the base fluid to each of the plurality of first pumps 200 to be pressurized. Once pressurized, the base fluid may be discharged by each of the plurality of first pumps 200 and combined by a local manifold, a piping system, and/or by other fluid combining means 154 operable to combine or otherwise direct the base fluid into one or more common fluid conduits 156. Although the fluid distribution and combining means 152, 154 are shown as separate elements, it is to be understood that the fluid distribution and combining means 152, 154 may be or comprise a single or common local manifold, piping system, and/or other fluid communication means operable to both distribute and combine fluid flows as described above. The pressurized base fluid may be communicated directly into the wellbore 104 via the one or more common fluid conduits 156.

As further shown in FIG. 1, the first mixture may also be discharged from the second mixer 124 and communicated to a second pump fleet 158 via one or more common fluid conduits 160. The first mixture may be distributed among a plurality of second pumps 200 of the second pump fleet 158 by a local manifold, a piping system, and/or by other fluid distribution means 161 operable to distribute or otherwise direct the first mixture to each of the plurality of second pumps 200 to be pressurized. Once pressurized, the first mixture may be discharged by each of the plurality of second pumps 200 and combined by a local manifold, a piping system, and/or by other fluid combining means 162 operable to combine or otherwise direct the first mixture into one or more common fluid conduits 164. Although the fluid distribution and combining means 161, 162 are shown as separate elements, it is to be understood that the fluid distribution and combining means 161, 162 may be or comprise a single or common local manifold, piping system, and/or other fluid communication means operable to both distribute and combine fluid flows as described above. The pressurized first mixture may be communicated directly into the wellbore 104 via the one or more common fluid conduits 164.

The second mixture may also be discharged from the third mixer 136 and communicated to a third pump fleet 166 via the one or more fluid conduits 142. The second mixture may be distributed among a plurality of third pumps 200 of the third pump fleet 166 by a local manifold, a piping system, and/or by other fluid distribution means 168 operable to distribute or otherwise direct the second mixture to each of the plurality of third pumps 200 to be pressurized. Once pressurized, the second mixture may be discharged by each of the plurality of third pumps 200 and combined by a local manifold, a piping system, and/or by other fluid combining means 170 operable to combine or otherwise direct the second mixture into one or more common fluid conduits 172. Although the fluid distribution and combining means 168, 170 are shown as separate elements, it is to be understood that the fluid distribution and combining means 168, 170 may be or comprise a single or common local manifold, piping system, and/or other fluid communication means operable to both distribute and combine fluid flows as described above. The pressurized second mixture may be communicated directly into the wellbore 104 via the one or more common fluid conduits 172.

The pumps 200 of the first, second, and third pump fleets 148, 158, 166 may be mounted on corresponding trucks, trailers, and/or other mobile carriers 174, 176, 178, such as may permit their transportation to the wellsite surface 102. However, one or more of the pump fleets 148, 158, 166 may be skidded or otherwise stationary, and/or may be temporarily or permanently installed at the wellsite surface 102. Although each pump fleet 148, 158, 166 is shown comprising three pumps 200 disposed on the corresponding mobile carrier 174, 176, 178, pump fleets 148, 158, 166 comprising other quantities of pumps 200 are also within the scope of the present disclosure. For example, one or more of the pump fleets 148, 158, 166 disposed on the corresponding mobile carrier 174, 176, 178 may comprise one, two, four or more pumps 200. Furthermore, although three pump fleets 148, 158, 166 are shown, other quantities of pump fleets 148, 158, 166 are also within the scope of the present disclosure. For example, the pumping system 100 may comprise one, two, four or more pump fleets 148, 158, 166 within the scope of the present disclosure.

The pumping system 100 may also comprise a control/power center 180, such as may be operable to provide control and/or centralized electric power distribution to one or more portions of the pumping system 100. The control/power center 180 may be or comprise an engine-generator set, such as may include a gas turbine generator, an internal combustion engine generator, and/or other sources of electric power. Electric power and/or control signals may be communicated between the control/power center 180 and other wellsite equipment via electric conductors (not shown). However, other means of signal communication, such as wireless communication, are also within the scope of the present disclosure.

The control/power center 180 may be employed to control at least a portion of the pumping system 100 during pumping operations. For example, the control/power center 180 may be operable to fluidly connect and disconnect the pump fleets 148, 158, 166 and the mixers 108, 124, 136 and/or to fluidly connect and disconnect the pump fleets 148, 158, 166 and the wellbore 104. The control/power center 180 may be further operable to control the production rate of the base fluid, the first mixture, and the second mixture. The control/power center 180 may also be operable to monitor and control operational parameters of each pump 200 of each pump fleet 148, 158, 166. For example, the control/power center 180 may be operable to monitor and control pressures and/or flow rates of the base fluid, the first mixture, and the second mixture discharged by each pump 200 of the corresponding pump fleet 148, 158, 166. The control/power center 180 may also be operable to control power distribution between a source of electric power and the first mixer 108, the second mixer 124, the third mixer 136, the pump assemblies 200, and other pumps and/or conveyers (not shown), such as may be operable to move the fluids, materials, and/or mixtures described above.

The control/power center 180 may be disposed on a corresponding truck, trailer, and/or other mobile carrier 181, such as may permit its transportation to the wellsite surface 102. However, the control/power center 180 may be skidded or otherwise stationary, and/or may be temporarily or permanently installed at the wellsite surface 102.

FIG. 1 shows the pumping system 100 operable to produce and/or mix fluids and/or mixtures that may be pressurized and individually or collectively injected into the wellbore 104 during hydraulic fracturing of the subterranean formation 106. However, it is to be understood that the pumping system 100 may be operable to produce and/or mix other fluids and/or mixtures that may be pressurized and individually or collectively injected into the wellbore 104 during other oilfield operations, such as drilling, cementing, acidizing, and/or water jet cutting operations, among other examples.

Figure 2:
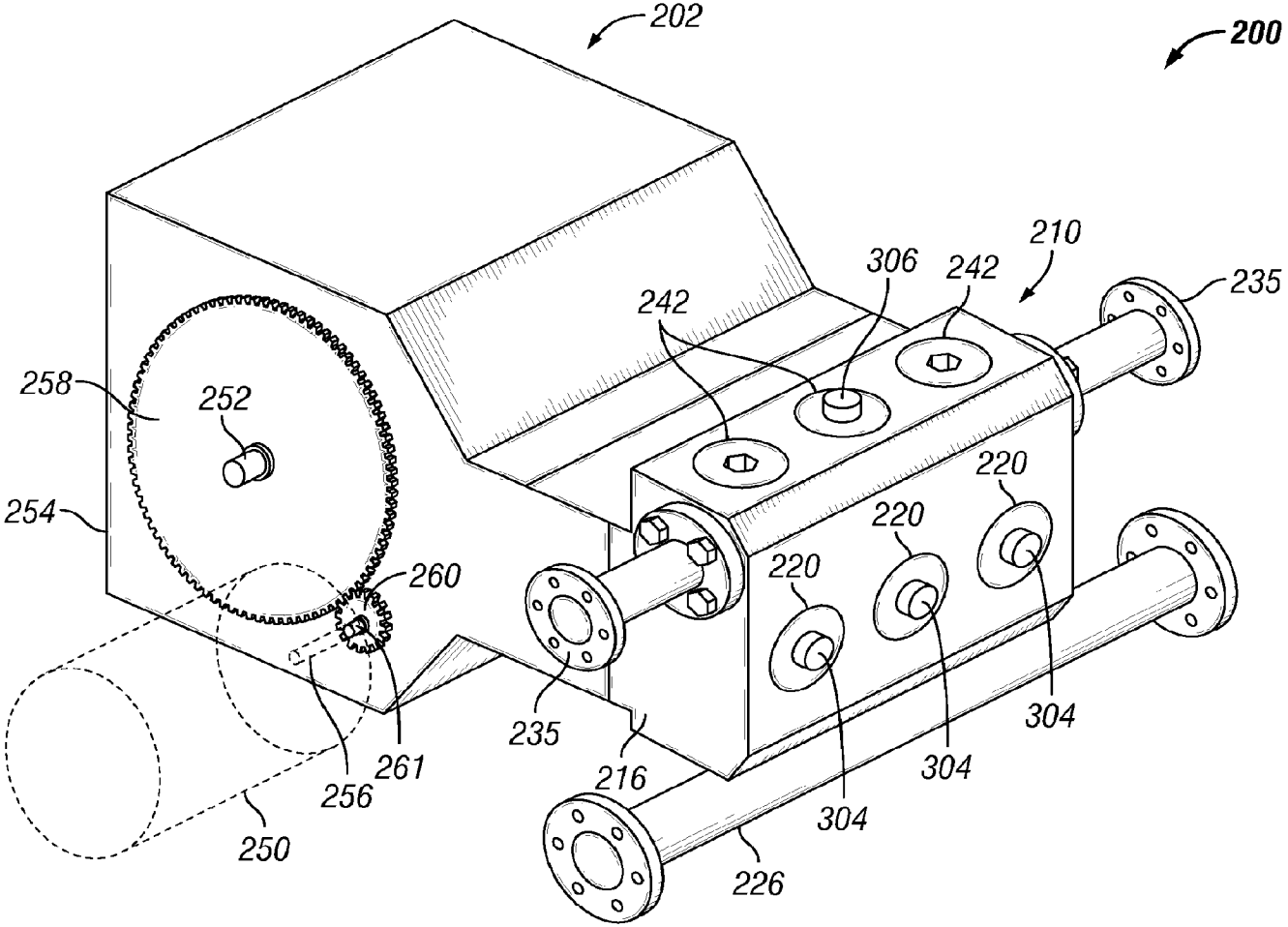
FIG. 2 is a perspective view of a portion of an example implementation of the apparatus shown in FIG. 1 according to one or more aspects of the present disclosure.
Figure 3:
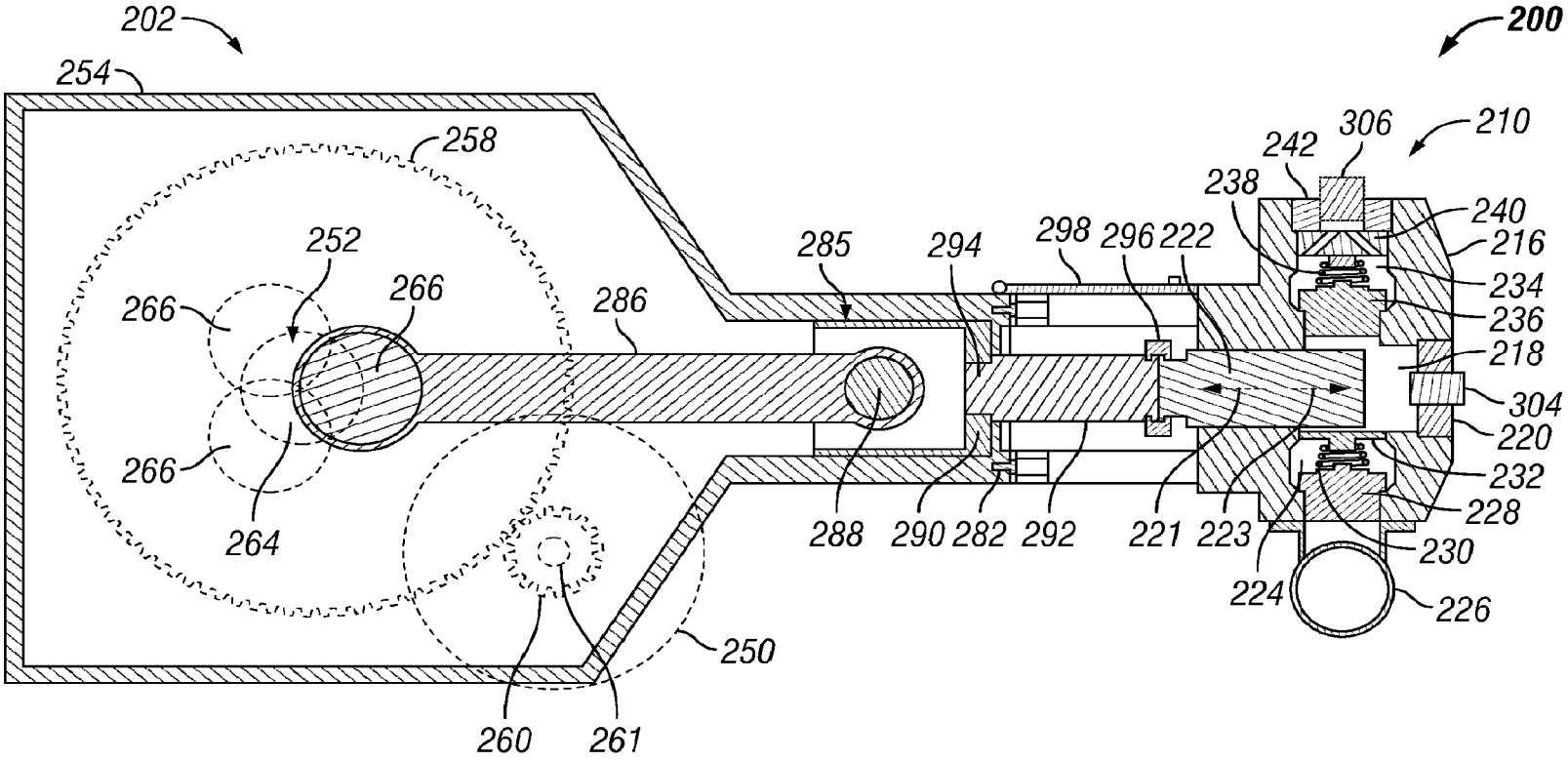
FIG. 3 is a side sectional view of a portion of an example implementation of the apparatus shown in FIG. 2 according to one or more aspects of the present disclosure.

The pumps 200 shown in FIG. 1 may each be substantially similar, although other implementations within the scope of the present disclosure may include different kinds and/or sizes of pumps. FIG. 2 is a perspective view of an example implementation of one of the pumps 200 shown in FIG. 1 according to one or more aspects of the present disclosure. FIG. 3 is a side sectional view of a portion of the pump 200 shown in FIG. 2. The following description refers to FIGS. 1-3, collectively.

The pump 200 may be or comprise a fixed displacement reciprocating pump assembly having a power section 202 and a fluid section 210. The fluid section 210 may comprise a pump housing 216 having a plurality of fluid chambers 218. One end of each fluid chamber 218 may be plugged by a cover plate 220, such as may be threadedly engaged with the pump housing 216. The opposite end of each fluid chamber 218 contains a reciprocating member 222 slidably disposed therein and operable to displace fluid within the corresponding fluid chamber 218. Although the reciprocating member 222 is depicted as a plunger, the reciprocating member 222 may also be implemented as a piston, diaphragm, or another reciprocating member.

Each fluid chamber 218 is fluidly connected with a corresponding one of a plurality of fluid inlet cavities 224 each adapted for communicating fluid from a fluid inlet conduit 226 into a corresponding fluid chamber 218. The fluid inlet conduit 226 may be or comprise at least a portion of the fluid distribution means 152, 160, 168 or the fluid conduits 150, 160, 142, and/or may otherwise be in fluid communication with one or more of the fluid distribution means 152, 160, 168 and/or one or more of the fluid conduits 150, 160, 142.

Each fluid inlet cavity 224 contains an inlet valve 228 operable to control fluid flow from the fluid inlet conduit 226 into the fluid chamber 218. Each inlet valve 228 may be biased toward a closed position by a first spring 230, which may be held in place by an inlet valve stop 232. Each inlet valve 228 may be actuated to an open position by a selected or predetermined differential pressure between the corresponding fluid inlet cavity 224 and the fluid inlet conduit 226.

Each fluid chamber 218 is also fluidly connected with a fluid outlet cavity 234 extending through the pump housing 216 transverse to the reciprocating members 222. The fluid outlet cavity 234 is adapted for communicating pressurized fluid from each fluid chamber 218 into one or more fluid outlet conduits 235. Each fluid outlet conduit 235 may be or comprise at least a portion of one or more of the fluid combining means 154, 162, 170 or one or more of the common fluid conduits 156, 164, 172, and/or may otherwise be in fluid communication with one or more of the fluid combining means 154, 162, 170 and/or one or more of the common fluid conduits 156, 164, 172, such as may facilitate injection of the fluid into the wellbore 104 during oilfield operations.

The fluid section 210 also contains a plurality of outlet valves 236 each operable to control fluid flow from a corresponding fluid chamber 218 into the fluid outlet cavity 234. Each outlet valve 236 may be biased toward a closed position by a second spring 238, which may be held in place by an outlet valve stop 240. Each outlet valve 236 may be actuated to an open position by a selected or predetermined differential pressure between the corresponding fluid chamber 218 and the fluid outlet cavity 234. The fluid outlet cavity 234 may be plugged by cover plates 242, such as may be threadedly engaged with the pump housing 216, and one or both ends of the fluid outlet cavity 234 may be fluidly coupled with the one or more fluid outlet conduits 235.

During pumping operations, portions of the power section 202 of the pump assembly 200 rotate in a manner that generates a reciprocating linear motion to move the reciprocating members 222 longitudinally within the corresponding fluid chambers 218, thereby alternatingly drawing and displacing fluid within the fluid chambers 218. With regard to each reciprocating member 222, as the reciprocating member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the first spring 230, thus actuating the fluid inlet valve 228 to an open position to permit the base fluid, first mixture, second mixture, or another fluid from the fluid inlet conduit 226 to enter the corresponding fluid inlet cavity 224. The fluid then enters the fluid chamber 218 as the reciprocating member 222 continues to move longitudinally out of the fluid chamber 218 until the pressure difference between the fluid inside the fluid chamber 218 and the fluid within the fluid inlet conduit 226 is low enough to permit the first spring 230 to actuate the fluid inlet valve 228 to the closed position. As the reciprocating member 222 begins to move longitudinally back into the fluid chamber 218, as indicated by arrow 223, the pressure of the fluid inside of fluid chamber 218 begins to increase. The fluid pressure inside the fluid chamber 218 continues to increase as the reciprocating member 222 continues to move into the fluid chamber 218 until the pressure difference between the fluid inside the fluid chamber 218 and the fluid inside the fluid outlet cavity 234 is high enough to compress the second spring 238, thus actuating the fluid outlet valve 236 to the open position and permitting the pressurized fluid to move into the fluid outlet cavity 234 and the fluid outlet conduit 235. Thereafter, the fluid may be communicated to the wellbore 104 or to another destination.

The fluid flow rate generated by the pump assembly 200 may depend on the physical size of the reciprocating members 222 and fluid chambers 218, as well as the pump speed or rate, which may be defined by the speed or rate at which the reciprocating members 222 cycle or move within the fluid chambers 218. The speed or rate at which the reciprocating members 222 move may be related to the rotational speed of the power section 202. Accordingly, the fluid flow rate may be controlled by the rotational speed of the power section 202.

The power section 202 of the pump assembly 200 may comprise a prime mover 250 operatively coupled with a drive shaft 252 enclosed and maintained in position by a power section housing 254, such that the prime mover 250 is operable to drive or otherwise rotate the drive shaft 252. The prime mover 250 may comprise a rotatable output shaft 256 operatively connected with the drive shaft 252 by a transmission or gear train, which may comprise a spur gear 258 coupled with the drive shaft 252 and a pinion gear 260 coupled with a support shaft 261. The output shaft 256 and the support shaft 261 may be coupled, such as may facilitate transfer of torque from the prime mover 250 to the support shaft 261, the pinion gear 260, the spur gear 258, and the drive shaft 252. To prevent relative rotation between the power section housing 254 and the prime mover 250, the power section housing 254 and prime mover 250 may be fixedly coupled together. The prime mover 250 may comprise an engine, such as a gasoline engine or a diesel engine, an electric motor, such as a synchronous or asynchronous electric motor, including a synchronous permanent magnet motor, a hydraulic motor, or another prime mover operable to rotate the drive shaft 252.

Figure 4:
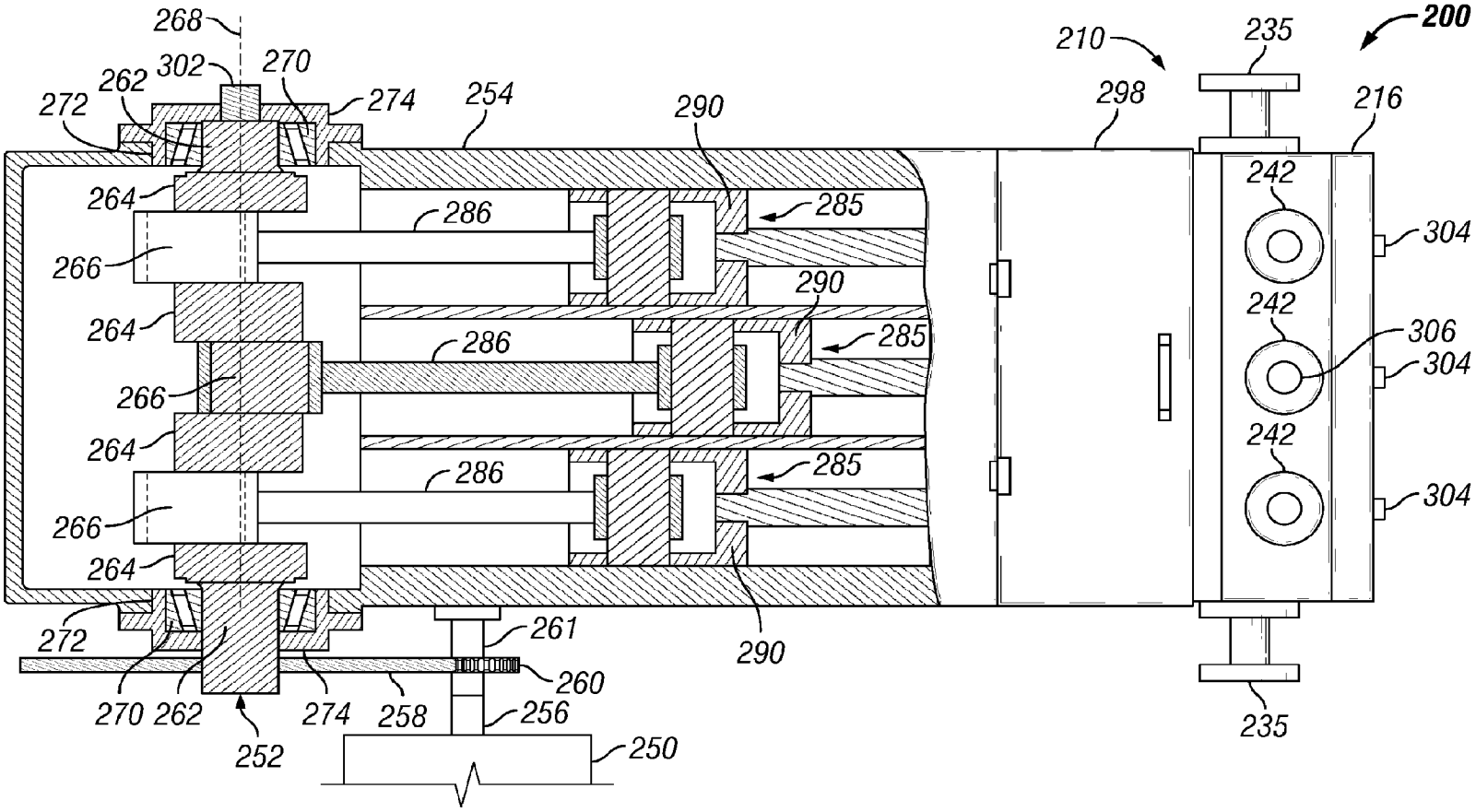
FIG. 4 is a top partial sectional view of a portion of an example implementation of the apparatus shown in FIG. 2 according to one or more aspects of the present disclosure.

FIG. 4 is a top partial sectional view of a portion of an example implementation of the pump assembly 200 shown in FIGS. 2 and 3 according to one or more aspects of the present disclosure. Referring to FIGS. 3 and 4, collectively, the drive shaft 252 may be implemented as a crankshaft comprising a plurality of support journals 262, main journals 264, and crankpin journals 266. The support and main journals 262, 264 may extend along a central axis of rotation 268 of the drive shaft 252, while the crankpin journals 266 may be offset from the central axis of rotation 268 by a selected or predetermined distance and spaced 120 degrees apart with respect to the support journals 262 and main journals 264. The drive shaft 252 may be supported in position within the power section 202 by the power section housing 254, wherein the support journals 262 may extend through opposing openings 272 in the power section housing 254. To facilitate rotation of the drive shaft 252 within the power section housing 254, one or more bearings 270 may be disposed about the support journals 262 and against the side surfaces of the openings 272. A cover plate and/or other means for protection 274 may enclose the bearings 270.

The power section 202 and the fluid section 210 may be coupled or otherwise connected together. For example, the pump housing 216 may be fastened with the power section housing 254 by a plurality of threaded fasteners 282. The pump assembly 200 may further comprise an access door 298, which may facilitate access to portions of the pump assembly 200 located between the power section 202 and the fluid section 210, such as during assembly and/or maintenance of the pump assembly 200.

To transform and transmit the rotational motion of the drive shaft 252 to a reciprocating linear motion of the reciprocating members 222, a plurality of crosshead mechanisms 285 may be utilized. For example, each crosshead mechanism 285 may comprise a connecting rod 286 pivotally coupled with a corresponding crankpin journal 266 at one end and with a pin 288 of a crosshead 290 at an opposing end. During pumping operations, walls and/or interior portions of the power section housing 254 may guide each crosshead 290, such as may reduce or eliminate lateral motion of each crosshead 290. Each crosshead mechanism 285 may further comprise a piston rod 292 coupling the crosshead 290, and thus, the drive shaft 252, with the reciprocating member 222 (not shown in FIG. 4). The piston rod 292 may be coupled with the crosshead 290 via a threaded connection 294 and with the reciprocating member 222 via a flexible connection 296.

Although FIGS. 2-4 show the pump 200 as a triplex reciprocating pump assembly comprising three fluid chambers 218 and three reciprocating members 222, other implementations within the scope of the present disclosure may include the pump 200 as or comprising a quintuplex reciprocating pump assembly comprising five fluid chambers 218 and five reciprocating members 222, or other quantities of fluid chambers 218 and reciprocating members 222. It is also noted that the prime movers 250 described above may be or comprise liquid cooled prime movers, such as in implementations in which one or more water jacket configurations (not shown) may be utilized to remove heat from the prime movers during pumping operations.

During operations of the pumping system 100, the fixed displacement reciprocating pumps 200 may discharge pressurized fluids in an oscillating manner or in spurts. Accordingly, some portions of the pumping system 100 may experience amplified high-pressure pulsations or spikes due to a resonance phenomenon caused by interaction of two or more oscillating fluid streams discharged from two or more pumps 200. Such amplified high-pressure spikes may be transmitted through or along the common fluid conduits 156, 164, 172, other piping systems, and/or other portions of the pumping system 100 fluidly connected downstream from the pumps 200. There may be a correlation between the occurrence of amplified high-pressure spikes within portions of the pumping system 100 and the speed of the pumps 200, fluid pressure, fluid flow, and/or acoustic lengths of piping and valves. There may also be a correlation between the amplified high-pressure spikes and phase relationship between the pumps 200 within a pump fleet 148, 158, 166. Therefore, the occurrence of the amplified high-pressure spikes may be reduced and/or eliminated by controlling the phase between the pumps 200, utilizing one or more methods or processes described below.

Figure 5:
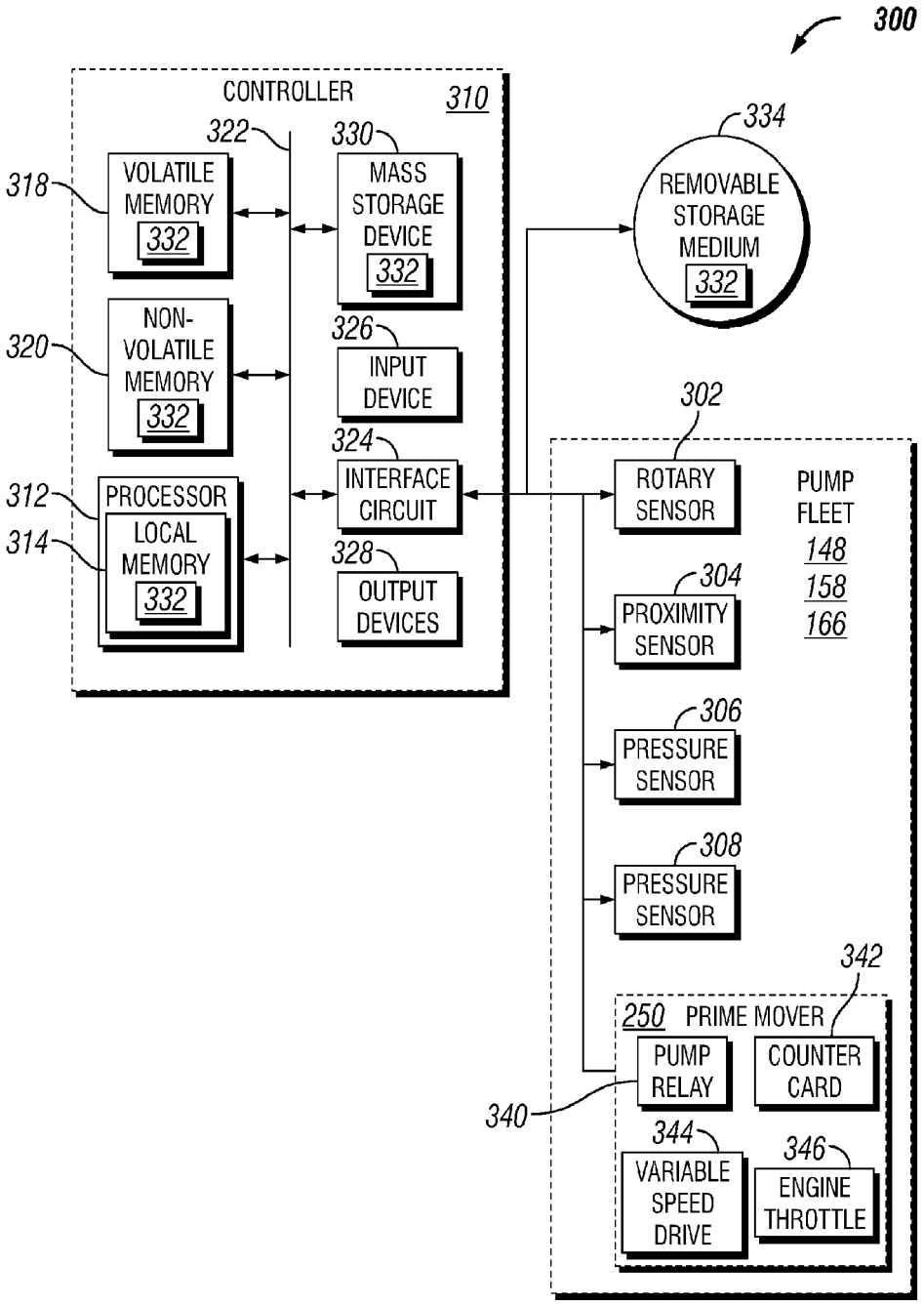
FIG. 5 is a schematic view of a portion of an example implementation of the apparatus shown in FIG. 1 according to one or more aspects of the present disclosure.

The pumping system 100 may further comprise a control system 300, which may be operable to monitor and/or control operations of the pumping system 100, including the phase and speed of one or more of the pumps 200. The control system 300 may monitor the phase and speed of the pumps 200 via a plurality of position sensors, which may be operable to generate signals or information relating to the phase and speed of the pumps 200. FIG. 5 is a schematic view of a portion of an example implementation of a control system 300 according to one or more aspects of the present disclosure. The following description refers to FIGS. 1-5, collectively.

The plurality of position sensors may comprise one or more rotary sensors 302 in association with each pump 200, such as may be operable to convert angular position or motion of the drive shaft 252 or another rotating component of the power section 202 to an electrical signal, such as to indicate phase and speed of the drive shaft 252 or another rotating component. For example, the rotary sensors 302 may be disposed adjacent an external portion of the drive shaft 252, such as the support journals 262 or other rotating members of the power section 202, and may be supported by the power section housing 254, the cover plate 274, or another portion of the power section 202. Each rotary sensor 302 may be or comprise an encoder, a rotary potentiometer, a synchro, a resolver, and/or a rotary variable differential transformer (RVDT), among other examples.

The plurality of position sensors may further comprise a plurality of proximity sensors 304 in association with each pump 200, such as may be operable to convert position or presence of the reciprocating members 222 or other moving or rotating component of the pump 200 to an electrical signal indicative of the position and/or speed of the moving component. The proximity sensors 304 may be disposed adjacent the reciprocating members 222, such that each proximity sensor 304 may detect a corresponding reciprocating member 222 during pumping operations. For example, each proximity sensor 304 may extend through the cover plate 220 or another portion of the pump housing 216 into a corresponding fluid chamber 218, whereby each proximity sensor 304 may detect the presence of a corresponding reciprocating member 222 at a selected or predetermined position, such as the top dead center position. The proximity sensors 304 may also be disposed adjacent the crosshead mechanisms 285 or the crankshafts 252, such that each proximity sensor 304 may detect presence and/or movement of the crosshead mechanism 285 or the crankshaft 252 and, therefore, detect the position and/or speed of each reciprocating member 222 during pumping operations. Each proximity sensor 304 may be or comprise a linear encoder, a capacitive sensor, an inductive sensor, a magnetic sensor, a Hall effect sensor, and/or a reed switch, among other examples.

The control system 300 may also comprise a plurality of pressure sensors in association with each pump 200, such as may be operable to measure fluid pressure downstream of the fluid chambers 218 and convert the fluid pressure to an electrical signal. The plurality of pressure sensors may comprise a first set of pressure sensors 306, which may be operable to measure fluid pressure at the fluid outlet of each pump 200. For example, each of the first set of pressure sensors 306 may extend through one or more cover plates 242 or another portion of the pump housing 216 into the fluid outlet cavity 234. The plurality of pressure sensors may further comprise a second set of pressure sensors 308 operable to measure fluid pressure downstream from each pump fleet 148, 158, 166. For example, each of the second set of pressure sensors 308 may be disposed along each of the common fluid conduits 156, 164, 172 to detect and/or measure fluid pressure therein.

The control system 300 may further comprise additional control components, such as a pump relay 340, a counter card 342, a variable speed drive 344, and/or an engine throttle 346, in association with each prime mover 250, wherein the control components may be operable to control the speed of each prime mover 250 and, therefore, control the speed of each pump 200. Although each pump relay 340, counter card 342, variable speed drive 344, and engine throttle 346 is shown as part of or in association with each prime mover 250, each pump relay 340, counter card 342, variable speed drive 344, and engine throttle 346 may be separate or disposed at a distance from the prime mover 250.

The control system 300 may comprise the variable speed drive 344 in implementations in which the prime mover 250 is or comprises an electric motor, or the control system 300 may comprise the engine throttle 346 in implementations in which the prime mover 250 is or comprises an engine. The pump relay 340 may be or comprise a synch pulse relay in electrical connection with a "party line," such as may facilitate synchronization of the pumps 200 within each pump fleet 148, 158, 166. Pump speed controllers, such as the variable speed drives 244 and engine throttles 346, may be operable to receive a synchronization timing pulse from the primary pump 200 or generate the synchronization timing pulse for the secondary pumps 200 of each pump fleet 148, 158, 166. During operations, the primary pump 200 may close its pump relay, while the secondary pumps 200 open their pump relays, permitting the secondary pumps 200 to receive the synchronization timing pulse from the primary pump 200. Accordingly, the pump relays 340 permit one pump 200, such as the primary pump 200, to control the party line at a time and, therefore, set the synchronization timing pulse for the secondary pumps 200 of each pump fleet 148, 158, 166. The counter card 342 may be operable to perform precise time measurements and/or count high frequency clock pulses. For example, the counter card 342 may comprise a crystal clock operable at sixteen megahertz (MHz), such as may permit the counter card 342 to count clock pulses with a resolution of 0.0000000625 seconds, among other examples within the scope of the present disclosure. Accordingly, the counter card 342 may facilitate accurate time measurements between synchronization timing pulses generated by the primary pump 200 and/or signals generated by the proximity sensors 304 or rotary sensors 302. Pump cycle time may also be determined by measuring time between each signal generated by the proximity sensors 304 or by measuring the time for the rotary sensor 302 to generate a series of signals corresponding to one complete revolution.

The control system 300 may also comprise a controller 310 in communication with the plurality of sensors 302, 304, 306, 308 and the prime mover control components 340, 342, 344, 346. FIG. 5 shows a schematic view of a portion of an example implementation of the controller 310 according to one or more aspects of the present disclosure. The controller 310 may be operable to execute example machine-readable instructions to implement at least a portion of one or more of the methods and/or processes described herein, and/or to implement a portion of one or more of the example downhole tools described herein. The controller 310 may be or comprise, for example, one or more processors, special-purpose computing devices, servers, personal computers, personal digital assistant ("PDA") devices, smartphones, internet appliances, and/or other types of computing devices.

The controller 310 may comprise a processor 312, such as a general-purpose programmable processor. The processor 312 may comprise a local memory 314, and may execute coded instructions 332 present in the local memory 314 and/or another memory device. The processor 312 may execute, among other things, machine-readable instructions or programs to implement the methods and/or processes described herein. The programs stored in the local memory 314 may include program instructions or computer program code that, when executed by an associated processor, facilitate the mixers 108, 124, 136, the pumps 200, and sensors 302, 304, 306, 308 to perform tasks as described herein. The processor 312 may be, comprise, or be implemented by one or a plurality of processors of various types suitable to the local application environment, and may include one or more of general-purpose computers, special-purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 312 may be in communication with a main memory, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The controller 310 may also comprise an interface circuit 324. The interface circuit 324 may be, comprise, or be implemented by various types of standard interfaces, such as an Ethernet interface, a universal serial bus (USB), a third generation input/output (3GIO) interface, a wireless interface, and/or a cellular interface, among others. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line ("DSL"), telephone line, coaxial cable, cellular telephone system, satellite, etc.).

The plurality of sensors 302, 304, 306, 308 may be connected with the controller 310 via the interface circuit 324, such as may facilitate communication between the sensors 302, 304, 306, 308 and the controller 310. The prime movers 250 may also be electrically connected with the controller 310, such as may permit the controller 310 to control the speed and, therefore, the phase of each prime mover 250. For example, the controller 310 may be in communication with the pump relay 340, the counter card 342, the variable speed drive 344, and/or the engine throttle 346, such as may facilitate control of the prime mover 250. Although each pump relay 340, counter card 342, variable speed drive 344, and engine throttle 346 is shown as part of or in association with each prime mover 250, each pump relay 340, counter card 342, variable speed drive 344, and/or engine throttle 346 may be integrated as part of or in association with the controller 310.

One or more input devices 326 may also be connected to the interface circuit 324. The input device(s) 326 may permit an operator to enter data and commands into the processor 312, such as the selected or predetermined phase difference, speed, flow, and/or pressure parameters described herein. The input device(s) 326 may be, comprise, or be implemented by a keyboard, a mouse, a touchscreen, a track-pad, a trackball, an isopoint, and/or a voice recognition system, among other examples. One or more output devices 328 may also be connected to the interface circuit 324. The output devices 328 may be, comprise, or be implemented by display devices (e.g., a liquid crystal display (LCD) or cathode ray tube display (CRT), among others), printers, and/or speakers, among other examples.

The controller 310 may also comprise one or more mass storage devices 330 for storing machine-readable instructions and data. Examples of such mass storage devices 330 include floppy disk drives, hard drive disks, compact disk (CD) drives, and digital versatile disk (DVD) drives, among others. The coded instructions 332 may be stored in the mass storage device 330, the volatile memory 318, the non-volatile memory 320, the local memory 314, and/or on a removable storage medium 334, such as a CD or DVD. Thus, the modules and/or other components of the controller 310 may be implemented in accordance with hardware (embodied in one or more chips including an integrated circuit, such as an application specific integrated circuit), or may be implemented as software or firmware for execution by a processor. In the case of firmware or software, the embodiment may be provided as a computer program product including a computer readable medium or storage structure embodying computer program code (i.e., software or firmware) thereon for execution by the processor 312.

The pumping system 100 may comprise a plurality of controllers 310, wherein each controller 310 may be implemented as part of and operable to control a corresponding pump fleet 148, 158, 166, and wherein each controller 310 may be disposed in association with the corresponding pump fleet 148, 158, 166 or mobile carrier 174, 176, 178. However, the pumping system 100 may also comprise a single controller 310 operable to control two or more pump fleets 148, 158, 166, wherein the single controller 310 may be operable to communicate with the sensors 302, 304, 306, 308 and prime movers 250 of two or more pump fleet 148, 158, 166. Whether the pumping system 100 comprises one or a plurality of controllers 310, one or more controllers 310 may be implemented as part of the control/power center 180.

Figure 6:
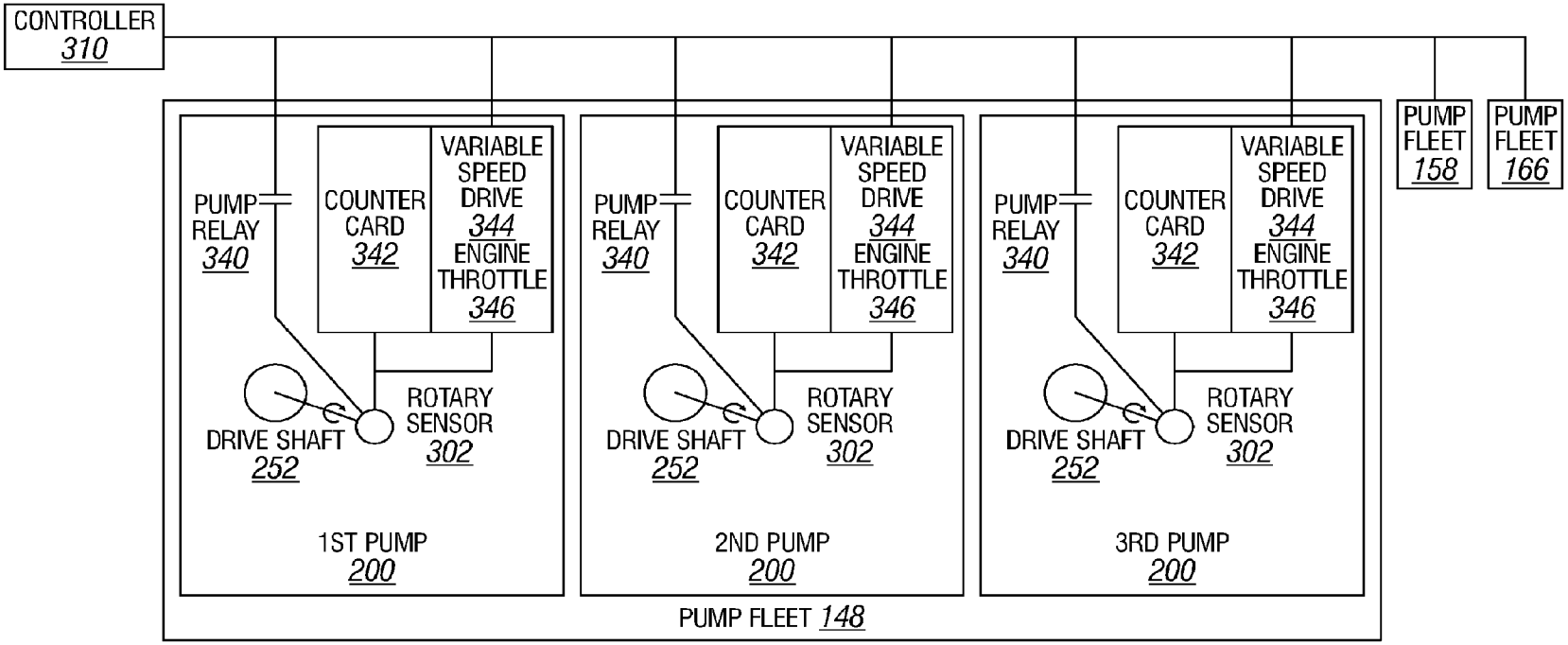
FIG. 6 is a schematic view of a portion of an example implementation of the apparatus shown in FIG. 1 according to one or more aspects of the present disclosure.
Figure 7:
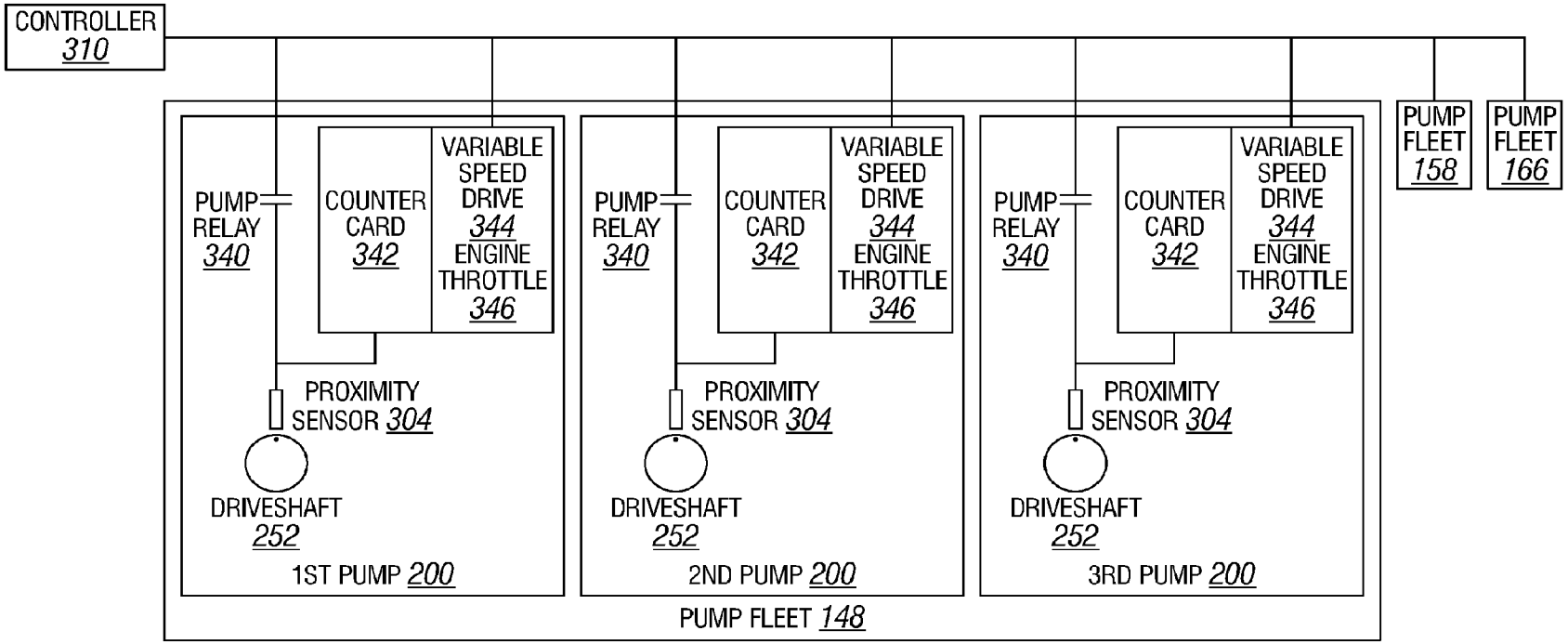
FIG. 7 is a schematic view of a portion of an example implementation of the apparatus shown in FIG. 1 according to one or more aspects of the present disclosure.

FIGS. 6 and 7 show additional schematic views of example implementations of the control system 300 according to one or more aspects of the present disclosure. The figures show the control system 300 in communication with each pump fleet 148, 158, 166, with individual pumps 200 within the pump fleet 148 in communication with the controller 310. For simplicity and clarity, individual pumps 200 of the pump fleets 158, 166 are not shown. However, it is to be understood that each pump 200 of the pump fleets 158, 166 are also in communication with the controller 310.

FIG. 6 shows the rotary sensors 302 in association with the drive shaft 252 to measure the phase and speed of each drive shaft 252. Phase and speed measurements may also be achieved using proximity sensors 304, which may be operable to detect the presence of the reciprocating members 222 or another moving portion of the pump 200, and/or to detect the presence of a reference point along the drive shaft 252 or another rotating portion of the pump 200, as shown in FIG. 7. Although FIGS. 6 and 7 show the controller 310 in communication with three pump fleets 148, 158, 166, each pump fleet 148, 158, 166 may be controlled by a separate controller 310, independently from the other controllers 310 and pump fleets 148, 158, 166.

Figure 8:
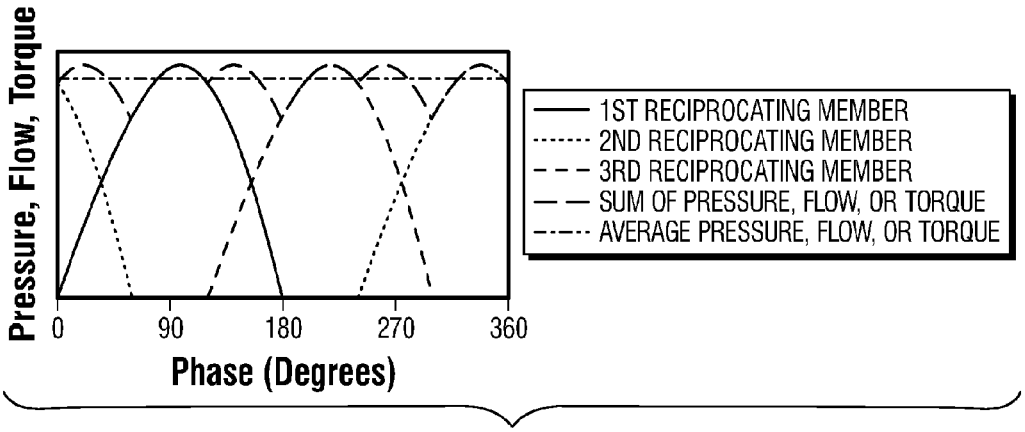
FIG. 8 is a graph related to one or more aspects of the present disclosure.
Figure 9:
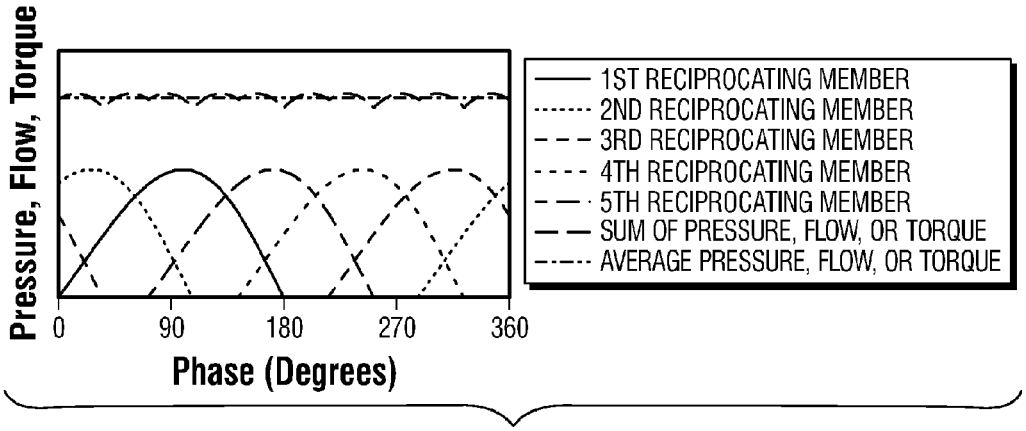
FIG. 9 is a graph related to one or more aspects of the present disclosure.

FIGS. 8 and 9 are graphs related to one or more aspects of the present disclosure, showing example peak-to-peak pressure, flow, and torque variations or spikes associated with the pumps 200. Pumps 200 comprising a larger number of reciprocating members 222 may generate smaller peak-to-peak pressure, flow, and torque variations or spikes during pumping operations. FIG. 8 shows an example relationship between pump phase, plotted along the horizontal axis, and pump output pressure, flow, and input torque, plotted along the vertical axis, associated with each pump 200 implemented as a triplex pump having three reciprocating members 222. The figure shows pressure, flow, and torque varying between about +6% and about −17% from an average pressure, flow, and torque. FIG. 9 shows an example relationship between pump phase, plotted along a horizontal axis, and pump output pressure, flow, and input torque, plotted along a vertical axis, associated with each pump 200 implemented as a quintuplex pump having five reciprocating members 222. The figure shows pressure, flow, and torque varying between about +2% and about −5% from an average pressure, flow, and torque.

The method or process for controlling the phase of one or more of the pumps 200 may comprise viewing the multiple pumps 200 as following: 1) n number of pumps 200 with p number of reciprocating members 222 may each be considered or simulated as a single combined pump with a "common drive shaft" with n×p reciprocating members 222, and 2) the "fluid end discharge" of the combined or simulated pump may be viewed as a volume above the outlet valves 236 for each individual pump 200, including each fluid outlet cavity 234, each fluid outlet conduit 235, and the common fluid conduits 156, 164, 172.

The ability to phase the pumps 200 of each pump fleet 148, 158, 166 according to how their combined reciprocating members 222 might look on a common crankshaft may reduce amplified high-pressure spikes formed downstream from each pump fleet 148, 158, 166. The combined pump "fluid end discharge" may be optimized such that negative interactions between each of the plurality of pumps 200 may be minimized, such that individual reciprocating members 222 of different pumps 200 do not "fight each other" by counter-flowing and creating hammering effects, which is not likely to occur substantially between reciprocating members 222 within a single pump 200.

Figure 10:
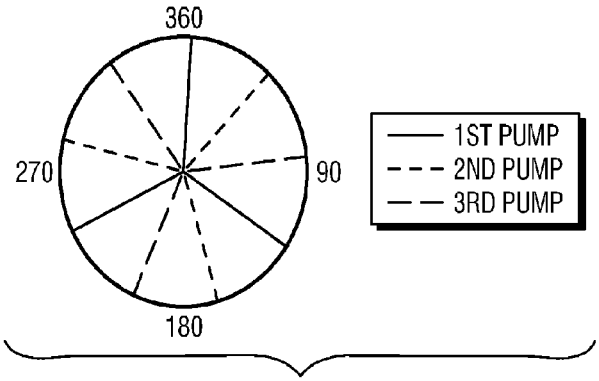
FIG. 10 is a graph related to one or more aspects of the present disclosure.

The control system 300 may be configured to maintain a selected or predetermined phase difference between each drive shaft 252 and, therefore, maintain a selected or predetermined phase difference between each set of reciprocating members 222. FIG. 10 is a graph related to one or more aspects of the present disclosure. The graph shows an example intended phase relationship between the reciprocating members 222 of one pump fleet 148, 158, 166 comprising three pumps 200 implemented as triplex pumps, wherein the circle represents phase and each set of lines represents position of each set of reciprocating members 222 of each pump 200. Each set of reciprocating members 222 is shown as being positioned substantially out of phase with respect to the reciprocating members 222 of another pump 200. The controller 310 may be programmed with instructions or may otherwise be operable to cause each prime mover 250 to phase the reciprocating members 222 as shown in FIG. 10.

The controller 310 may be operable to adjust the phase of the reciprocating members 222 of the pumps 200 by adjusting the speed of the prime movers 250, which are mechanically coupled with the reciprocating members 222 via the drive shaft 252 and the plurality of crosshead mechanisms 285. Because the drive shaft 252 and the reciprocating members 222 are mechanically coupled, the phase of the pump 200 (i.e., the linear position of the reciprocating members 222) is known from the rotational position or the phase of the drive shaft 252. Therefore, the controller 310 may control the speed of the pumps 200 by controlling the engine throttle 346, such as in implementations in which the prime mover 250 comprises an engine, or controlling the variable speed drive 344, such as in implementations in which the prime mover 250 comprises an electric motor.

To control the relative phase between the plurality of pumps 200, the controller 310 or the operator may first select one of the pumps 200 as a reference or primary pump 200 to be operated at a selected or predetermined speed, while the relative phase and speed of other or secondary pumps 200 may be adjusted in relation to the primary pump 200. Thereafter, the controller 310 may maintain the selected or predetermined phase difference and synchronized speed between the primary pump 200 and the secondary pumps 200, resulting in relative phasing of the reciprocating members 222 of the pumps 200, as depicted in FIG. 10.

For example, the control method or process for adjusting the phase of the pumps 200 within the fleet 148, 158, 166 may comprise: (1) bringing the primary pump 200 up to the selected speed, (2) matching the speed of the secondary pumps 200 to the speed of the primary pump 200 to synchronize the pumps 200, (3) adjusting the set points of the speed (i.e., slowing down or speeding up) of the secondary pumps to establish the selected phase difference between the primary and secondary pumps 200, and (4) again matching the speed of the secondary pumps 200 to the speed of the primary pump 200 to synchronize the pumps 200. If the primary pump 200 becomes inoperable or otherwise goes down, one of the secondary pumps 200 may take over as the primary pump 200, and re-phasing may be performed with respect to the new primary pump 200. If one or more of the secondary pumps 200 becomes inoperable or goes down, the remaining pumps 200 may be re-phased with respect to the primary pump 200.

During phase control operations, the one or more rotary sensors 302 and/or proximity sensors 304 may generate position and/or speed feedback signals, such as may permit the controller 310 to determine the phase and speed of the drive shaft 252 and/or the reciprocating members 222 and make speed adjustments to maintain the selected phase difference. For pumps 200 utilizing a rotary sensor 302, the phase of a secondary pump 200, in units of degrees, may be determined by: (1) calculating number of signals generated by the rotary sensor 302 after the synchronization timing pulse from the primary pump 200 is detected, (2) dividing the calculated number of signals by the number of signals the rotary sensor 302 generates per revolution, and (3) multiplying the quotient by 360. For pumps 200 utilizing a proximity sensor 304, the phase of a secondary pump 200, in units of degrees, may be determined by: (1) calculating time elapsed between when the signal generated by the proximity sensor 304 and the synchronization timing pulse is detected, (2) dividing the calculated time by time elapsed between signals from the proximity sensor 304, and (3) multiplying the quotient by 360. A signal corresponding to the selected phase may then be added to the engine throttle 346 or variable speed drive 344 control signal to control the phase of the motor 200.

The control method described above may be optimized when the pumps 200, gear trains, and/or prime movers 250 within the fleets 148, 158, 166 are substantially the same or similar, and may also be operable to control fleets 148, 158, 166 comprising different pumps 200, gear trains, and/or prime movers 250. A selected or predetermined output flow rate may be utilized as an input parameter to the controller 310, which may decide a corresponding speed of the pumps 200 to achieve the selected output flow rate. In an example implementation, the controller 310 may match speed of the pumps 200 and bias the speed of each pump by about −1% to about +1% of the selected speed. The phase bias may then be added to a reference signal from the controller 310 to the engine throttle 346 or variable speed drive 344 to control phase between the pumps 200, such that the reciprocating members 222 may be out of phase with each other and thus minimize resonance phenomena downstream.

Instead of or in addition to phasing the pumps 200 within each pump fleet 148, 158, 166 based on the position of the reciprocating members 222, the controller 310 may be operable to phase the pumps 200 within each pump fleet 148, 158, 166 based on information generated by the first and/or second sets of pressure sensors 306, 308.

As the resonance phenomenon may be caused by amplification of fluid pressure oscillations or spikes generated by each of two or more pumps during pumping operations, the pumps 200 within each pump fleet 148, 158, 166 may be operated such that the fluid pressure spikes generated by one pump 200 are out of phase with the fluid pressure spikes generated by another pump 200. For example, during pumping operations, the first set of pressure sensors 306 may be operable to generate information relating to fluid pressure spikes generated by the reciprocating members 222 and transmitted to the fluid outlet cavities 234 and fluid outlet conduits 235 of the pumps 200. After the information is received by the controller 310, the controller 310 may be operable to cause each prime mover 250 to adjust the phase of each pump 200, as described above, based on the information relating to pressure spikes generated by pressure sensors 306, instead of the position of the reciprocating members 222. Consequently, each fluid pressure spike may be realized within each fluid outlet cavity 234 and/or fluid outlet conduit 235 out of phase or at a different time with respect to another fluid pressure spike of another pump 200. Furthermore, the phase and speed of the drive shaft 252 or other portions of the pump 200 may be monitored by the plurality of position sensors 302, 304, as described above, wherein the controller 310 may be operable to "capture and learn" or otherwise correlate the occurrence of each fluid pressure spike with the position of the drive shaft 252 or other portions of the pump 200. Under such control method or process, the fluid pressure spikes detected by the pressure sensors 306 may be substantially out of phase with each other, while the drive shafts 252 or other portions of the pumps 200 may not be substantially out of phase. Therefore, the angles between the reciprocating members 222 of each pump 200 may not be equal, but may be subject to the phase relationship between the fluid pressure spikes. Prior to or after the selected phase is achieved, the controller 310 may synchronize the speeds of the pumps 200, as described above.

The phase relationship of each pump 200 within each pump fleet 148, 158, 166 may also be subject to the occurrence of the amplified high-pressure spikes caused by resonance phenomena within the one or more common fluid conduits 164, 156, 172 or other portions of the pumping system located downstream of each pump fleet 148, 158, 166. For example, during pumping operations, the second set of pressure sensors 308 may be operable to generate information relating to the amplified high-pressure spikes or other fluid pressure spikes within the one or more common fluid conduits 164, 156, 172 or other portions of the pumping system located downstream of each pump fleet 148, 158, 166. After the information is received by the controller 310, if an amplified high-pressure spike or another pressure spike exceeding a selected or predetermined pressure level is detected in the fluid conduit 164, 156, 172, the controller 310 may be operable to cause one or more prime movers 250 to adjust the phase of one or more secondary pumps 200 with respect to the primary pump 200, as described above. The phase and speed of each pump 200 may be monitored by the plurality of position sensors 302, 304, as described above.

Under such control method or process, the reciprocating members 222 and/or drive shafts 252 of each pump 200 may not be substantially out of phase with each other, because the phasing of the pumps is controlled by the occurrence of the amplified high-pressure spikes within one or more common fluid conduits 164, 156, 172, independent of the relative position or phase between the drive shafts 252 or the reciprocating members 222 of each pump 200. Therefore, the angles between the reciprocating members 222 of each pump 200 may not be equal, but may be subject to the occurrence of the amplified high-pressure spikes within one or more of the common fluid conduits 164, 156, 172. The occurrence of the amplified high-pressure spikes may also depend on functional and structural parameters of each fleet 148, 158, 166 and/or other portions of the pumping system 100, such as pump speeds, fluid pressures, fluid flow rates, acoustic lengths and material of piping and valves, and fluid compressibility, among other examples.

The controller 310 may continue to adjust the phase of one or more secondary pumps 200 until the amplified high-pressure spikes or other pressure spikes in the common fluid conduits 164, 156, 172 are below the selected pressure level. After the amplified high-pressure spikes in the common fluid conduits 164, 156, 172 are eliminated or reduced below the selected pressure level, the controller 310 may cause the prime mover 250 to maintain the phase of each pump 200 substantially constant. Prior to or after the amplified high-pressure spikes are eliminated or reduced below the selected pressure level, the controller 310 may synchronize the speeds of the pumps 200, as described above.

Under another control method or process, the controller 310 may be operable to continuously and/or randomly change the relative phase between the plurality of pumps 200 within each fleet 148, 158, 166. For example, the controller 310 may continuously and/or randomly adjust the phase relationship between the primary and secondary pumps 200, such as by about one percent or more, to prevent the formation of amplified high-pressure spikes. The controller 310 may also be operable to differentiate or continuously and/or randomly adjust the speeds of the secondary pumps 200 with respect to the primary pump 200, such as by about one percent or more. The differences in pump speeds may result in fluid pressure oscillations or spikes of each fluid stream to be generated and/or comprise different frequencies, thus preventing the formation of amplified high-pressure spikes downstream from each fleet 148, 158, 166. Accordingly, the amplified high-pressure spikes within the fluid conduits 156, 164, 172 caused by the resonance phenomenon during interaction of two or more oscillating fluid streams discharged from two or more pumps 200 may not be generated, as the fluid pressure oscillations or spikes of two or more fluid streams may not fall into phase.

Figure 11:
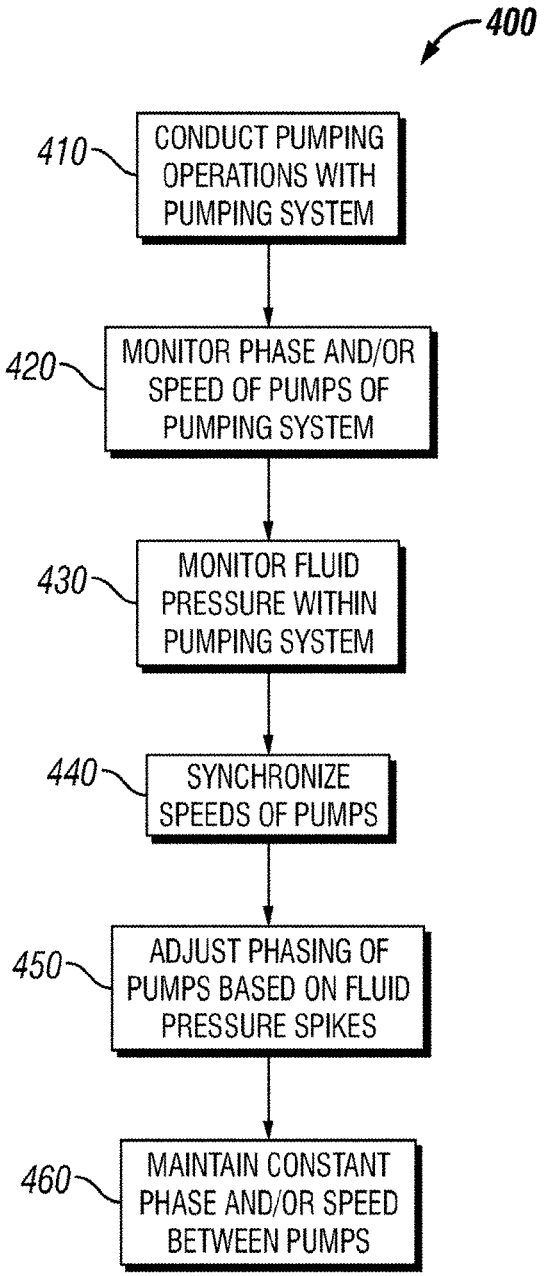
FIG. 11 is a flow-chart diagram of at least a portion of a method according to one or more aspects of the present disclosure.

FIG. 11 is a flow-chart diagram of at least a portion of a method (400) according to one or more aspects of the present disclosure. The method (400) may be performed utilizing at least a portion of one or more implementations of the apparatus shown in one or more of FIGS. 1-7 and/or otherwise within the scope of the present disclosure.

The method (400) comprises conducting (410) pumping operations with a plurality of pumps 200 each comprising a drive shaft 252, a prime mover 250 operatively coupled with the drive shaft 252, and a plurality of reciprocating members 222. Conducting (410) pumping operations comprises powering each prime mover 250 to rotate each drive shaft 252 and thereby cause each of the plurality of reciprocating members 222 to reciprocate and thereby pump a fluid. While conducting (410) pumping operations, the phase and speed of each of the plurality of pumps 200 is monitored (420), and the fluid pressure within a pumping system 100 comprising the pumps 200 is also monitored (430), including information relating to fluid pressure spikes within the pumping system 100.

The speed of each of the pumps 200 may also be synchronized (440). For example, synchronizing (440) the speed of each of the pumps 200 may comprise selecting one of the pumps 200 as a primary pump, causing the primary pump 200 to operate at a predetermined speed, and causing one of the pumps 200 other than the primary pump 200 to operate at a substantially same speed as the primary pump 200.

The phase of one or more of the pumps 200 may also be adjusted (450) with respect to the phase of another of the pumps 200 based on the information relating to fluid pressure spikes within the pumping system 100. For example, each of the pumps 200 may further comprise a pump fluid outlet, and monitoring (430) fluid pressure within the pumping system 100 may comprise monitoring the fluid pressure at each pump fluid outlet for the fluid pressure spikes. Adjusting (450) the phase of one or more of the pumps 200 may comprise causing one or more prime movers 250 to adjust the phase between the pumps 200 such that each fluid pressure spike at each fluid outlet is out of phase with respect to another fluid pressure spike at another fluid outlet.

The pumping system 100 may further comprise a common fluid pathway fluidly coupled with each pump fluid outlet. In such implementations, monitoring (430) fluid pressure within the pumping system 100 may comprise monitoring the fluid pressure within the common fluid pathway for the fluid pressure spikes, and adjusting (450) the phase of one or more of the pumps 200 may comprise causing one or more prime movers 250 to adjust the phase of one or more of the pumps 200 with respect to another of the pumps 200 when the fluid pressure spikes exceeding a predetermined pressure level are detected in the common fluid pathway. The method (400) may also include causing (460) the prime movers 250 to maintain a substantially constant phase between each of the pumps 200 when the fluid pressure spikes within the common fluid pathway are decreased below the predetermined pressure level.

In view of the entirety of the present disclosure, including the claims and the figures, a person having ordinary skill in the art will readily recognize that the present disclosure introduces an apparatus comprising: a pumping system, comprising: a plurality of pumps each comprising: a drive shaft; a prime mover operatively coupled with the drive shaft and operable to rotate the drive shaft; a plurality of reciprocating members operable to pump a fluid; a plurality of connecting rods operatively connecting the drive shaft with the plurality of reciprocating members; and a pump fluid outlet; and a control system, comprising: a plurality of position sensors each associated with a corresponding one of the plurality of pumps, wherein each of the plurality of position sensors is operable to generate information relating to phase and/or speed of the corresponding one of the plurality of pumps; a plurality of pressure sensors each associated with a corresponding one of the plurality of pumps, wherein each of the plurality of pressure sensors is operable to generate information relating to fluid pressure spikes at a corresponding pump fluid outlet; and a controller in communication with the plurality of position sensors and the plurality of pressure sensors, wherein the controller is operable to cause each of the plurality of pumps to operate such that each fluid pressure spike at each pump fluid outlet is out of phase with respect to another fluid pressure spike at another pump fluid outlet.

The drive shaft may comprise a crankshaft. The prime mover may comprise an engine, an electric motor, or a hydraulic motor. The plurality of reciprocating members may comprise a plurality of pistons, plungers, or diaphragms. Each of the plurality of position sensors may comprise an encoder, a rotational position sensor, a rotational speed sensor, a proximity sensor, or a linear position sensor. The plurality of pumps may comprise a plurality of positive displacement reciprocating pumps.

The controller may be further operable to correlate the occurrence of each fluid pressure spike to the phase of a corresponding one of the plurality of pumps, and the controller may cause each prime mover to control the phase of each of the plurality of pumps such that a phase difference is maintained between each fluid pressure spike at each fluid outlet. The controller may also or instead be operable to cause each prime mover to adjust the phase of each of the plurality of pumps such that each fluid pressure spike at each fluid outlet is out of phase with respect to another fluid pressure spike at another fluid outlet.

The pumping system may further comprise a common fluid pathway fluidly coupled with each pump fluid outlet, the control system may further comprise another pressure sensor operable to generate information relating to fluid pressure spikes within the common fluid pathway, and the controller may be operable to cause the prime mover to adjust the phase of one or more of the plurality of pumps with respect to another of the plurality of pumps when one or more fluid pressure spikes exceeding a predetermined pressure level are detected in the common fluid pathway. In such implementations the controller may be further operable to cause each prime mover to maintain a substantially constant phase between each of the plurality of pumps when the one or more fluid pressure spikes in the common fluid pathway are below the predetermined pressure level.

The pumping system may be a first pumping system, the first pumping system may further comprise a first common fluid outlet fluidly connected with each pump fluid outlet, the apparatus may further comprise a second pumping system comprising a second common fluid outlet, the first common fluid outlet may be fluidly coupled with a wellhead via a first fluid conduit, the second common fluid outlet may be fluidly coupled with the wellhead via a second fluid conduit, and the first and second fluid conduits may be fluidly isolated from each other.

The present disclosure also introduces an apparatus comprising: a pumping system, comprising: a plurality of pumps each comprising: a housing; a pump fluid outlet; a drive shaft disposed within the housing; a prime mover operatively coupled with the drive shaft and operable to rotate the drive shaft; and a plurality of fluid displacing members operatively coupled with the drive shaft; a common fluid conduit fluidly coupled with each pump fluid outlet; and a control system, comprising: a plurality of position sensors each associated with a corresponding one of the plurality of pumps, wherein each of the plurality of position sensors is operable to generate information relating to phase and/or speed of the corresponding one of the plurality of pumps; a plurality of pressure sensors each operable to generate information relating to fluid pressure spikes; and a controller in communication with the plurality of position sensors and the plurality of pressure sensors, wherein the controller is operable to cause the prime mover to: adjust the phase of one or more of the plurality of pumps with respect to the phase of another of the plurality of pumps based on the information relating to fluid pressure spikes; and synchronize the speed of the plurality of pumps.

The drive shaft may comprise a crankshaft. The prime mover may comprise an engine, an electric motor, or a hydraulic motor. The plurality of fluid displacing members may comprise a plurality of pistons, plungers, or diaphragms. Each of the plurality of position sensors may comprise an encoder, a rotational position sensor, a rotational speed sensor, a proximity sensor, or a linear position sensor. The plurality of pumps may comprise a plurality of positive displacement reciprocating pumps.

Each of the plurality of pressure sensors may be disposed in association with a corresponding one of the plurality of pumps, each of the plurality of pressure sensors may be operable to generate information relating to fluid pressure spikes at the pump fluid outlet of the corresponding one of the plurality of pumps, the controller may be further operable to correlate the occurrence of each fluid pressure spike to the phase of the corresponding one of the plurality of pumps, and the controller may cause each prime mover to control the phase of each of the plurality of pumps such that a phase difference is maintained between each fluid pressure spike at each fluid outlet.

Each of the plurality of pressure sensors may be operable to generate information relating to fluid pressure spikes at the pump fluid outlet of the corresponding one of the plurality of pumps, and the controller may be operable to cause each prime mover to adjust the phase of each of the plurality of pumps such that each fluid pressure spike at each fluid outlet is out of phase with respect to another fluid pressure spike at another fluid outlet.

Each of the plurality of pressure sensors may be disposed in association with the common fluid conduit, each of the plurality of pressure sensors may be operable to generate information relating to fluid pressure spikes within the common fluid conduit, and the controller may be operable to cause the prime mover to adjust the phase of one or more of the plurality of pumps with respect to the phase of another of the plurality of pumps when fluid pressure spikes exceeding a predetermined pressure level are detected in the common fluid pathway. In such implementations, the controller may be further operable to cause the prime mover of each of the plurality of pumps to maintain a substantially constant phase between each of the plurality of pumps when the fluid pressure spikes within the common fluid pathway are below the predetermined pressure level.

The pumping system may be a first pumping system, the first pumping system may further comprise a first common fluid outlet fluidly connected with each pump fluid outlet, the apparatus may further comprise a second pumping system comprising a second common fluid outlet, the first common fluid outlet may be fluidly coupled with a wellhead via a first fluid conduit, the second common fluid outlet may be fluidly coupled with the wellhead via a second fluid conduit, and the first and second fluid conduits may be fluidly isolated from each other.

The present disclosure also introduces a method comprising: conducting pumping operations with a plurality of pumps each comprising a drive shaft, a prime mover operatively coupled with the drive shaft, and a plurality of reciprocating members, wherein conducting pumping operations comprises powering each prime mover to rotate each drive shaft and thereby cause each of the plurality of reciprocating members to reciprocate and thereby pump a fluid; monitoring phase and/or speed of each of the plurality of pumps; monitoring fluid pressure within a pumping system comprising the plurality of pumps, including information relating to fluid pressure spikes within the pumping system; synchronizing the speed of each of the plurality of pumps; and adjusting the phase of one or more of the plurality of pumps with respect to the phase of another of the plurality of pumps based on the information relating to fluid pressure spikes within the pumping system.

Synchronizing the speed of each of the plurality of pumps may comprise: selecting one of the plurality of pumps as a primary pump; causing the primary pump to operate at a predetermined speed; and causing one of the plurality of pumps other than the primary pump to operate at a substantially same speed as the primary pump.

Each of the plurality of pumps may further comprise a pump fluid outlet, monitoring fluid pressure within the pumping system may comprise monitoring the fluid pressure at each pump fluid outlet for the fluid pressure spikes, and adjusting the phase of one or more of the plurality of pumps may comprise causing one or more prime movers to adjust the phase between the plurality of pumps such that each fluid pressure spike at each fluid outlet is out of phase with respect to another fluid pressure spike at another fluid outlet.

Each of the plurality of pumps may further comprise a pump fluid outlet, the pumping system may further comprise a common fluid pathway fluidly coupled with each pump fluid outlet, monitoring fluid pressure within the pumping system may comprise monitoring the fluid pressure within the common fluid pathway for the fluid pressure spikes, and adjusting the phase of one or more of the plurality of pumps may comprise causing one or more prime movers to adjust the phase of one or more of the plurality of pumps with respect to another of the plurality of pumps when the fluid pressure spikes exceeding a predetermined pressure level are detected in the common fluid pathway. In such implementations, the method may further comprise causing the prime movers to maintain a substantially constant phase between each of the plurality of pumps when the fluid pressure spikes within the common fluid pathway are decreased below the predetermined pressure level.

The pumping system may comprise: a first pumping system comprising a first common fluid pathway fluidly coupled with a plurality of first pumps; and a second pumping system comprising a second common fluid pathway fluidly coupled with a plurality of second pumps. In such implementations, the method may further comprise: communicating a first fluid from the first pumping system to a wellbore via the first common fluid pathway; and communicating a second fluid in isolation from the first fluid from the second pumping system to the wellbore via the second common fluid pathway.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a pumping system, comprising:

a plurality of pumps each comprising:

a drive shaft;

a prime mover operatively coupled with the drive shaft and operable to rotate the drive shaft;

a plurality of reciprocating members operable to pump a fluid;

a plurality of connecting rods operatively connecting the drive shaft with the plurality of reciprocating members; and a pump fluid outlet; and a control system, comprising:

a plurality of position sensors each associated with a corresponding one of the plurality of pumps, wherein each of the plurality of position sensors is operable to generate information relating to phase and/or speed of the corresponding one of the plurality of pumps;

a plurality of pressure sensors each associated with a corresponding one of the plurality of pumps, wherein each of the plurality of pressure sensors is operable to generate information relating to fluid pressure spikes at a corresponding pump fluid outlet; and a controller in communication with the plurality of position sensors and the plurality of pressure sensors, wherein the controller is operable to cause each of the plurality of pumps to operate such that each fluid pressure spike at each pump fluid outlet is out of phase with respect to another fluid pressure spike at another pump fluid outlet, wherein the controller is further operable to correlate the occurrence of each fluid pressure spike to the phase of a corresponding one of the plurality of pumps, and wherein the controller causes each prime mover to control the phase of each of the plurality of pumps such that a phase difference is maintained between each fluid pressure spike at each fluid outlet.

2. The apparatus of claim 1 wherein the prime mover comprises an engine, an electric motor, or a hydraulic motor.

3. The apparatus of claim 1 wherein each of the plurality of position sensors comprises an encoder, a rotational position sensor, a rotational speed sensor, a proximity sensor, or a linear position sensor.

4. The apparatus of claim 1 wherein the plurality of pumps comprises a plurality of positive displacement reciprocating pumps.

5. The apparatus of claim 1 wherein the controller is operable to cause each prime mover to adjust the phase of each of the plurality of pumps such that each fluid pressure spike at each fluid outlet is out of phase with respect to another fluid pressure spike at another fluid outlet.

6. The apparatus of claim 1 wherein the pumping system further comprises a common fluid pathway fluidly coupled with each pump fluid outlet, wherein the control system further comprises another pressure sensor operable to generate information relating to fluid pressure spikes within the common fluid pathway, and wherein the controller is operable to cause the prime mover to adjust the phase of one or more of the plurality of pumps with respect to another of the plurality of pumps when one or more fluid pressure spikes exceeding a predetermined pressure level are detected in the common fluid pathway.

7. The apparatus of claim 6 wherein the controller is further operable to cause each prime mover to maintain a substantially constant phase between each of the plurality of pumps when the one or more fluid pressure spikes in the common fluid pathway are below the predetermined pressure level.

8. The apparatus of claim 1 wherein:

the pumping system is a first pumping system;

the first pumping system further comprises a first common fluid outlet fluidly connected with each pump fluid outlet;

the apparatus further comprises a second pumping system comprising a second common fluid outlet;

the first common fluid outlet is fluidly coupled with a wellhead via a first fluid conduit;

the second common fluid outlet is fluidly coupled with the wellhead via a second fluid conduit; and the first and second fluid conduits are fluidly isolated from each other.

9. An apparatus, comprising:

a pumping system, comprising:

a plurality of pumps each comprising:

a housing;

a pump fluid outlet;

a drive shaft disposed within the housing;

a prime mover operatively coupled with the drive shaft and operable to rotate the drive shaft; and a plurality of fluid displacing members operatively coupled with the drive shaft;

a common fluid conduit fluidly coupled with each pump fluid outlet; and a control system, comprising:

a plurality of position sensors each associated with a corresponding one of the plurality of pumps, wherein each of the plurality of position sensors is operable to generate information relating to phase and/or speed of the corresponding one of the plurality of pumps;

a plurality of pressure sensors each operable to generate information relating to fluid pressure spikes; and a controller in communication with the plurality of position sensors and the plurality of pressure sensors, wherein the controller is operable to cause the prime mover to:

adjust the phase of one or more of the plurality of pumps with respect to the phase of another of the plurality of pumps based on the information relating to fluid pressure spikes; and synchronize the speed of the plurality of pumps, wherein each of the plurality of pressure sensors is operable to generate information relating to fluid pressure spikes at the pump fluid outlet of the corresponding one of the plurality of pumps, and wherein the controller is operable to cause each prime mover to adjust the phase of each of the plurality of pumps such that each fluid pressure spike at each fluid outlet is out of phase with respect to another fluid pressure spike at another fluid outlet.

10. The apparatus of claim 9 wherein each of the plurality of pressure sensors is disposed in association with a corresponding one of the plurality of pumps, wherein each of the plurality of pressure sensors is operable to generate information relating to fluid pressure spikes at the pump fluid outlet of the corresponding one of the plurality of pumps, wherein the controller is further operable to correlate the occurrence of each fluid pressure spike to the phase of the corresponding one of the plurality of pumps, and wherein the controller causes each prime mover to control the phase of each of the plurality of pumps such that a phase difference is maintained between each fluid pressure spike at each fluid outlet.

11. The apparatus of claim 9 wherein each of the plurality of pressure sensors is disposed in association with the common fluid conduit, wherein each of the plurality of pressure sensors is operable to generate information relating to fluid pressure spikes within the common fluid conduit, and wherein the controller is operable to cause the prime mover to adjust the phase of one or more of the plurality of pumps with respect to the phase of another of the plurality of pumps when fluid pressure spikes exceeding a predetermined pressure level are detected in the common fluid pathway.

12. The apparatus of claim 11 wherein the controller is further operable to cause the prime mover of each of the plurality of pumps to maintain a substantially constant phase between each of the plurality of pumps when the fluid pressure spikes within the common fluid pathway are below the predetermined pressure level.

13. A method, comprising:

conducting pumping operations with a plurality of pumps each comprising a drive shaft, a prime mover operatively coupled with the drive shaft, and a plurality of reciprocating members, wherein conducting pumping operations comprises powering each prime mover to rotate each drive shaft and thereby cause each of the plurality of reciprocating members to reciprocate and thereby pump a fluid;

monitoring phase and/or speed of each of the plurality of pumps;

monitoring fluid pressure within a pumping system comprising the plurality of pumps, including information relating to fluid pressure spikes within the pumping system;

synchronizing the speed of each of the plurality of pumps; and adjusting the phase of one or more of the plurality of pumps with respect to the phase of another of the plurality of pumps based on the information relating to fluid pressure spikes within the pumping system.

14. The method of claim 13 wherein synchronizing the speed of each of the plurality of pumps comprises:

selecting one of the plurality of pumps as a primary pump;

causing the primary pump to operate at a predetermined speed; and causing one of the plurality of pumps other than the primary pump to operate at a substantially same speed as the primary pump.

15. The method of claim 13 wherein each of the plurality of pumps further comprises a pump fluid outlet, wherein monitoring fluid pressure within the pumping system comprises monitoring the fluid pressure at each pump fluid outlet for the fluid pressure spikes, and wherein adjusting the phase of one or more of the plurality of pumps comprises causing one or more prime movers to adjust the phase between the plurality of pumps such that each fluid pressure spike at each fluid outlet is out of phase with respect to another fluid pressure spike at another fluid outlet.

16. The method of claim 13 wherein each of the plurality of pumps further comprises a pump fluid outlet, wherein the pumping system further comprises a common fluid pathway fluidly coupled with each pump fluid outlet, wherein monitoring fluid pressure within the pumping system comprises monitoring the fluid pressure within the common fluid pathway for the fluid pressure spikes, and wherein adjusting the phase of one or more of the plurality of pumps comprises causing one or more prime movers to adjust the phase of one or more of the plurality of pumps with respect to another of the plurality of pumps when the fluid pressure spikes exceeding a predetermined pressure level are detected in the common fluid pathway.

17. The method of claim 16 further comprising causing the prime movers to maintain a substantially constant phase between each of the plurality of pumps when the fluid pressure spikes within the common fluid pathway are decreased below the predetermined pressure level.

18. The method of claim 13 wherein the pumping system comprises:

a first pumping system comprising a first common fluid pathway fluidly coupled with a plurality of first pumps; and a second pumping system comprising a second common fluid pathway fluidly coupled with a plurality of second pumps; and the method further comprises:

communicating a first fluid from the first pumping system to a wellbore via the first common fluid pathway; and communicating a second fluid in isolation from the first fluid from the second pumping system to the wellbore via the second common fluid pathway.

* * * * *